United States Patent [19]

Ewards

[11] 4,115,887

[45] Sep. 26, 1978

[54] SHIP'S EMBARKATION DEVICE FOR E.G. PILOTS

[75] Inventor: Gunnar Ewards, Askim, Sweden

[73] Assignee: AB Welin, Askim, Sweden

[21] Appl. No.: 812,408

[22] Filed: Jul. 1, 1977

[30] Foreign Application Priority Data

Jul. 6, 1976 [SE] Sweden ..... 7607699

[51] Int. Cl.[2] ..... E04G 3/00

[52] U.S. Cl. ..... 9/1.6; 182/84

[58] Field of Search ..... 9/1.6; 114/258, 259, 114/261, 262, 263; 182/84

[56] References Cited

U.S. PATENT DOCUMENTS 3,856,110 12/1974 Nilsson ..... 182/84

FOREIGN PATENT DOCUMENTS 1,429,395 3/1976 United Kingdom ..... 9/1.6

*Primary Examiner*—Trygve M. Blix
*Assistant Examiner*—D. W. Keen
*Attorney, Agent, or Firm*—Holman & Stern

[57] ABSTRACT

A ship's embarkation device is provided, which despite moderate heeling (10°-13°) of the ship is kept against the ship's side. The embarkation device is for this purpose provided with at least one turning weight, which in relation to the ship's side is placed outside the central longitudinal plane of the device and thus gives it a turning moment directed towards the ship's side.

8 Claims, 4 Drawing Figures

SHIP'S EMBARKATION DEVICE FOR E.G. PILOTS

BACKGROUND OF THE INVENTION

The present invention refers to a ship's embarkation device for e.g. pilots and comprising a projecting means, extending substantially parallel to the ship's side, said projecting means at one of its ends being pivotally mounted in the vertical plane and unrotatably connected in the horizontal plane to a bracket mounted at the ship's deck, at the opposite end of the projecting means a platform being pivotally mounted, said platform by means of a wire arrangement being supported by two davit arms, said davit arms by means of an axle extending in the longitudinal direction of the ship being unrotatably connected to said bracket.

The embarkation of persons to a big ship at sea from a small boat, e.g. from a pilot boat, can nowadays preferably be made by that the person by way of a pilot's ladder boards a platform, which by means of a winch is lifted to the ship's deck. The projecting means mentioned in the introduction can also comprise an accomodation ladder, by means of which the person can board the ship.

The problem with embarkation devices of this kind is that they will swing out from and in towards the ship's side concurrently with the movements of the ship, which can be unpleasant and dangerous for the persons boarding the ship. It also occurs that a ship waiting for e.g. a pilot is placed so that the pilot boat comes on the lee side, at which the ship turns one of its broadsides towards the wind and owing to that inclines somewhat. The embarkation device will owing to that hang out a bit from the ship's side. Under such circumstances the pilot for obvious reasons refuses to embark or leave the ship.

OBJECT OF THE INVENTION

The purpose of the present invention is to provide an embarkation device of the above mentioned kind, which despite inclination and heeling of the ship up to about 10°–13° holds the platform against the ship's side.

SUMMARY OF THE INVENTION

This has according to the invention been achieved by that the embarkation device is provided with at least one means which in relation to the ship's side is placed outside a central longitudinal plane through the embarkation device and is intended to give said device a component force directed towards the ship's side, said force being stronger than the force striving to swing the device out from the ship's side when the ship heels moderately.

DESCRIPTION OF SOME PREFERRED EMBODIMENTS

Figure 1:
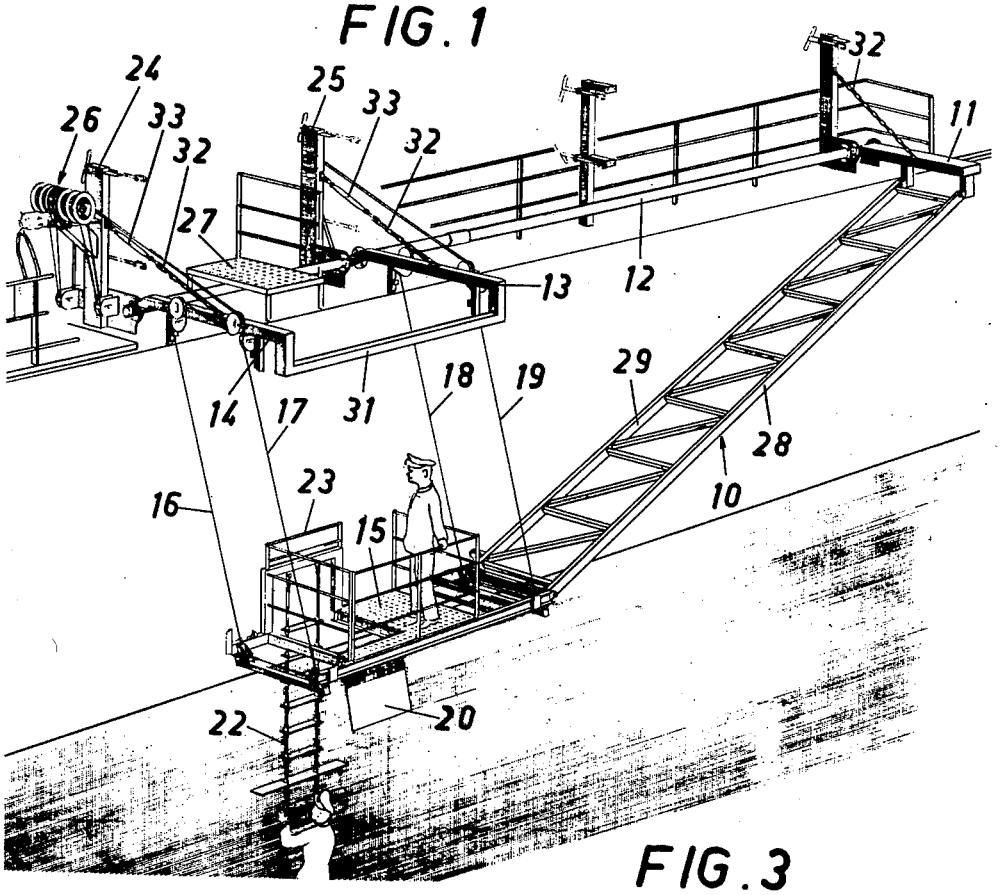
FIG. 1 is a perspective view of the device according to the invention.

In the drawings the numeral 10 denotes a projecting means e.g. a tubular or a framework structure or a ladder. The projecting means 10 is at its upper end pivotally mounted in the vertical plane to a bracket 11, which is mounted to an axle 12 extending in the longitudinal direction of the ship. The axle is connected to a first davit arm 13 and to a second davit arm 14 at some distance. Thus the bracket 11 is by means of the axle 12 unrotatably connected to the davit arms 13 and 14.

At the free end of the projecting means 11 a platform 15 is pivotally mounted, which is supported by four wires 16, 17, 18 and 19. The platform 15 has a rectangular shape and is provided with an access opening, which can be closed by a hatch 20. At the side of the platform 15 facing the ship's side a pilot's ladder 22 is attached under the access opening. The platform is further surrounded by a rail 23.

The platform is at its respective corners provided with guides for the wires 16–19, which by way of pulley wheels at the davit arms 13 and 14 and at the support pillars 24 and 25 are led to a winch 26, which preferably comprises a winding drum for each wire.

At the embarkation the device takes the position shown in FIG. 1. The pilot enters the platform 15 by way of the pilot's ladder 22, the platform is then lifted to the ship's deck and the pilot can by way of the embarkation platform 27 embark the ship. As is previously mentioned the projecting means 10 can comprise a ladder, at which the pilot embarks the ship from the platform 15 by way of said ladder.

Figure 3:
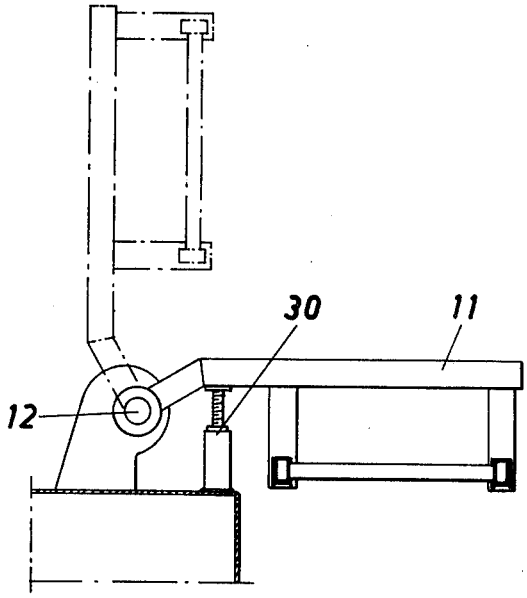
FIG. 3 is a side view of a somewhat modified embodiment of the bracket to which the projecting means is pivotally attached.
Figure 2:
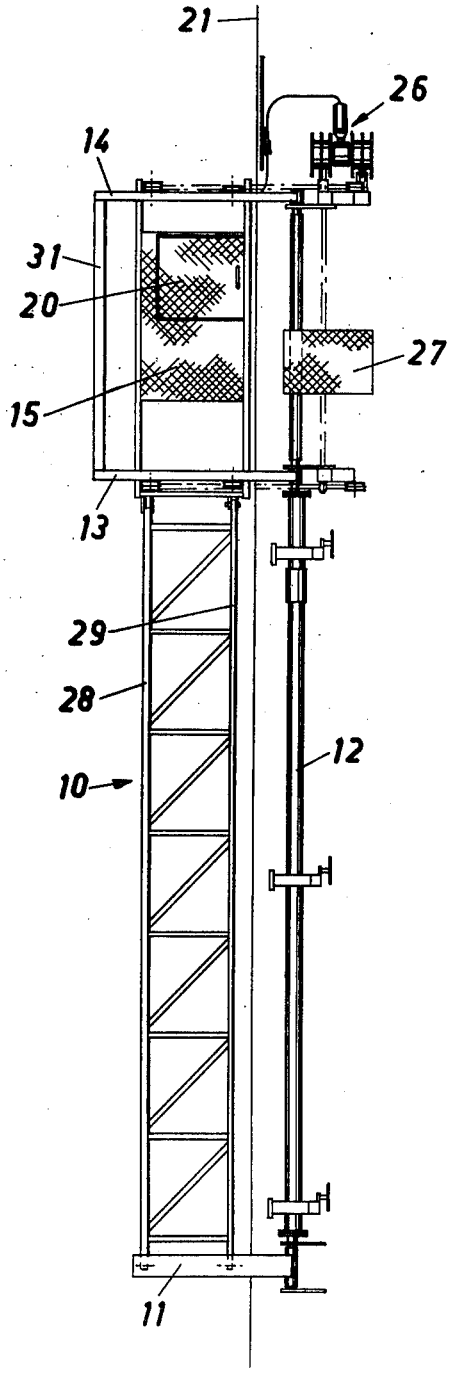
FIG. 2 is a plane view of the device according to FIG. 1.

When the projecting means 10 and the platform 15 have been lifted to the ship's deck the davit arms 13, 14 can in a known manner be pivoted about 90° upwards, at which also the bracket 11 by means of the axle 12 is pivoted about 90° and takes the position indicated with dash dotted lines in FIG. 3.

This device is in substance previously known, and as is mentioned the problem has been that it swings out from and in towards the ship's side when the ship heels, and hangs out from the ship's side without control when the ship has a list. According to the invention these drawbacks are avoided by placing the centre of gravity of the device so that the device by its own weight is given a component force directed towards the ship's side, i.e. strives to contact the ship's side even when the ship heels or has a list. According to the embodiment shown this component force is achieved by a preferably solid beam 31 being arranged between the free ends of the davit arms 13 and 14. Said beam 31 gives the davit arms a turning moment directed towards the ship's side 21, said turning moment by way of the axle 12 and the bracket 11 being transferred to the projecting means 10 and the platform 15. According to the embodiment shown the longitudinal beam 28 of the projecting means 10 remote from the ship's side is made heavier than the beam 29 facing the ship's side, i.e. the centre of gravity of the device is placed so far from the axle 12, that the device is given a strong component force directed towards the ship's side.

Figure 4:
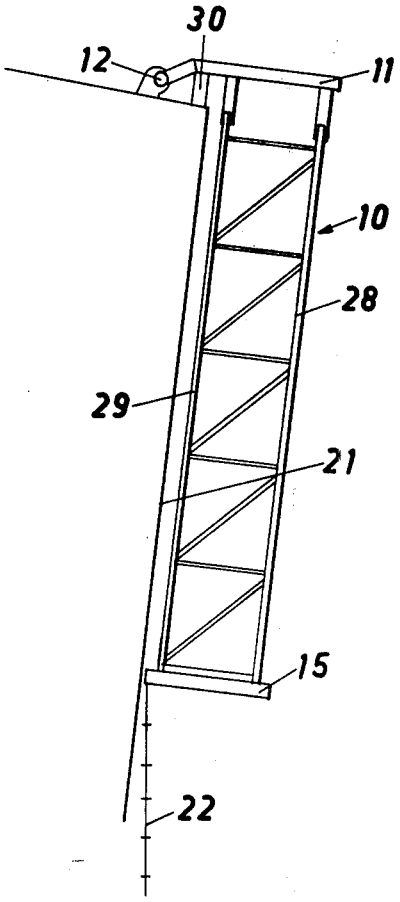
FIG. 4 is a side view of the projecting means in a position where the ship inclines.

In FIG. 4 is shown that the platform 15 still contacts the ship's side 21 despite that the ship has a list.

In FIG. 1 is shown that the davit arms 13, 14 and the bracket 11 are supported by chains 32, which limit the rotational movement of the davit arms and the bracket. The length of the chains 32 can be adjusted by means of stretching screws 33. A stretching screw can of course also be arranged at the chain supporting the bracket, although this is not shown in the drawing.

In the embodiment according to the FIGS. 3 and 4 a support member 30 is arranged for limiting the rotational movement of the bracket 11. The support member 30 is preferably shortenable and extensible, e.g. by comprising a spindle, which is threaded into a sleeve as is shown in the figures.

The invention is not limited to the embodiment shown, but there are several possibilities to achieve and strengthen the desired change of the centre of gravity of the embarkation device. For example the side of the platform 15 remote from the ship's side can be made extra heavy.

What I claim is:

1. In a ship's embarkation device for e.g. pilots comprising a projecting means extending substantially parallel to the ship's side, said projecting means at one of its ends being pivotally mounted in the vertical plane and unrotatably connected in the horizontal plane to a bracket mounted at the ship's deck, at the opposite end of the projecting means a platform being pivotally mounted, said platform by means of a wire arrangement being supported by two davit arms, said davit arms by means of an axle extending in the longitudinal direction of the ship being unrotatably connected to said bracket, the improvement wherein the embarkation device is provided with at least one means, which in relation to the ship's side is placed outside a central longitudinal plane through the embarkation device for giving said device a component force directed towards the ship's side, said force being stronger than the force striving to swing the device out from the ship's side when the ship heels moderately (10°-13°).

2. The improvement according to claim 1, wherein said means for giving a component force comprises a preferably solid beam extending between the free ends of the davit arms.

3. The improvement according to claim 1, wherein the projecting means comprises a pair of longitudinal beams, viz. an outer beam remote from the ship's side and an inner beam facing the ship's side, at which the outer beam is heavier than the inner beam in order to provide said means for giving a component force.

4. The improvement according to claim 1, wherein means are arranged for limiting the rotational movement of the bracket.

5. The improvement according to claim 4, wherein said means comprises a chain supporting the bracket in its active position.

6. The improvement according to claim 5, wherein the length of the chain is adjustable by means of a stretching screw.

7. The improvement according to claim 4, wherein said means comprises a support member arranged under the bracket.

8. The improvement according to claim 7, wherein the length of the support member is adjustable.

* * * * *